US007401996B2

(12) United States Patent
Neusch

(10) Patent No.: US 7,401,996 B2
(45) Date of Patent: Jul. 22, 2008

(54) CABLE-RELEASE ANCHOR ASSEMBLY

(75) Inventor: William H. Neusch, Marble Falls, TX (US)

(73) Assignee: Neusch Innovations, LP, Burnet, TX (US)

( * ) Notice: Subject to any disclaimer, the term of this patent is extended or adjusted under 35 U.S.C. 154(b) by 127 days.

(21) Appl. No.: 11/175,630

(22) Filed: Jul. 6, 2005

(65) Prior Publication Data

US 2007/0020045 A1 Jan. 25, 2007

(51) Int. Cl.
*E01F 15/00* (2006.01)

(52) U.S. Cl. ..... 404/6; 404/9; 404/10; 256/13.1

(58) Field of Classification Search ..... 404/9, 404/10, 6; 256/13.1
See application file for complete search history.

(56) References Cited

U.S. PATENT DOCUMENTS 2,265,698 A * 12/1941 Opgenorth ..... 256/13.1
4,501,411 A * 2/1985 Otaki ..... 256/13.1
4,928,928 A * 5/1990 Buth et al. ..... 256/13.1
5,022,782 A * 6/1991 Gertz et al. ..... 404/6
5,078,366 A * 1/1992 Sicking et al. ..... 256/13.1
5,245,787 A * 9/1993 Swenson et al. ..... 49/34
5,484,217 A * 1/1996 Carroll et al. ..... 403/2
5,490,661 A * 2/1996 Stevens et al. ..... 256/13.1
5,503,495 A * 4/1996 Mak et al. ..... 404/6
5,924,680 A * 7/1999 Sicking et al. ..... 256/13.1
5,957,435 A 9/1999 Bronstad
6,065,738 A 5/2000 Pearce et al.
6,220,575 B1 4/2001 Lindsay et al.
6,299,141 B1 10/2001 Lindsay et al.
6,382,583 B1 5/2002 Hill, III et al.
6,398,192 B1 6/2002 Albritton
6,488,268 B1 12/2002 Albritton
6,619,630 B2 9/2003 Albritton
6,729,607 B2 5/2004 Alberson et al.
6,783,116 B2 8/2004 Albritton
6,793,204 B2 9/2004 Albritton
6,863,264 B2 3/2005 Johansson et al.
6,902,151 B1 6/2005 Nilsson
6,932,327 B2 8/2005 Alberson et al.
2003/0222254 A1 12/2003 Bergendahl
2006/0043353 A1 3/2006 Titmua
2006/0102884 A1 5/2006 Rohde et al.

FOREIGN PATENT DOCUMENTS

GB 2417509 A 1/2006

* cited by examiner

*Primary Examiner*—Raymond W Addie
(74) *Attorney, Agent, or Firm*—Winstead PC; Henry L. Ehrlich

(57) ABSTRACT

A cable-release anchor assembly including a cable mounting plate adapted for removably holding a cable proximate its terminal end and a leveraging member positioned to release the cable from the terminal end when the leveraging member is impacted. The cable may be connected to a safety system such as, but not limited to, a cable barrier system, W-beam guardrail, and/or an energy absorption system.

4 Claims, 9 Drawing Sheets

CABLE-RELEASE ANCHOR ASSEMBLY

RELATED APPLICATIONS

This application is related to co-pending U.S. patent application Ser. No. 11/175,940, entitled Cable Barrier System, filed on Jul. 6, 2005; and U.S. patent application Ser. No. 11/175,939, entitled Releasable Post-Cable Connection For A Cable Barrier System, filed Jul. 6, 2005. The above identified patent applications are incorporated herein by reference.

FIELD OF THE INVENTION

The present invention relates in general to barriers and safety systems and more particularly to a cable-release anchor.

BACKGROUND

Barrier systems are provided for many situations in which it is desired to redirect an object and/or to absorb the energy of an errant object. Common barrier systems include roadway barriers, such as, W-beam guardrails, cable barrier systems, and energy-absorption systems. These roadway barrier systems typically separate roadways from roadside hazards and/or opposing roadways. However, these barrier systems have a terminal end that often poses a significant risk to vehicle occupants.

Therefore, it is a desire to provide a cable-release anchor assembly for barrier systems that addresses concerns of impacts with the terminal end of a barrier system.

SUMMARY OF THE INVENTION

An embodiment of the cable-release anchor assembly includes a cable mounting plate adapted for removably holding a cable proximate its terminal end and a leveraging member positioned to release the cable from the terminal end when the leveraging member is impacted. The cable may be connected to a safety system such as, but not limited to, a cable barrier system, W-beam guardrail, and/or an energy absorption system.

The cable may be removably connected to the cable mounting plate by being disposed in a slot. The cable may be removably connected to the cable mounting plate by providing a frangible section proximate the second end of the cable, whereby the cable parts at the frangible section when the leveraging member is impacted.

In an embodiment of the present invention the leveraging member includes a base positioned under the terminal end of the cable, wherein the leveraging member is not fixedly secured to the cable mounting plate. It may also be a desire for the leveraging member to disconnect the cable no matter the direction from which the leveraging member is impacted.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
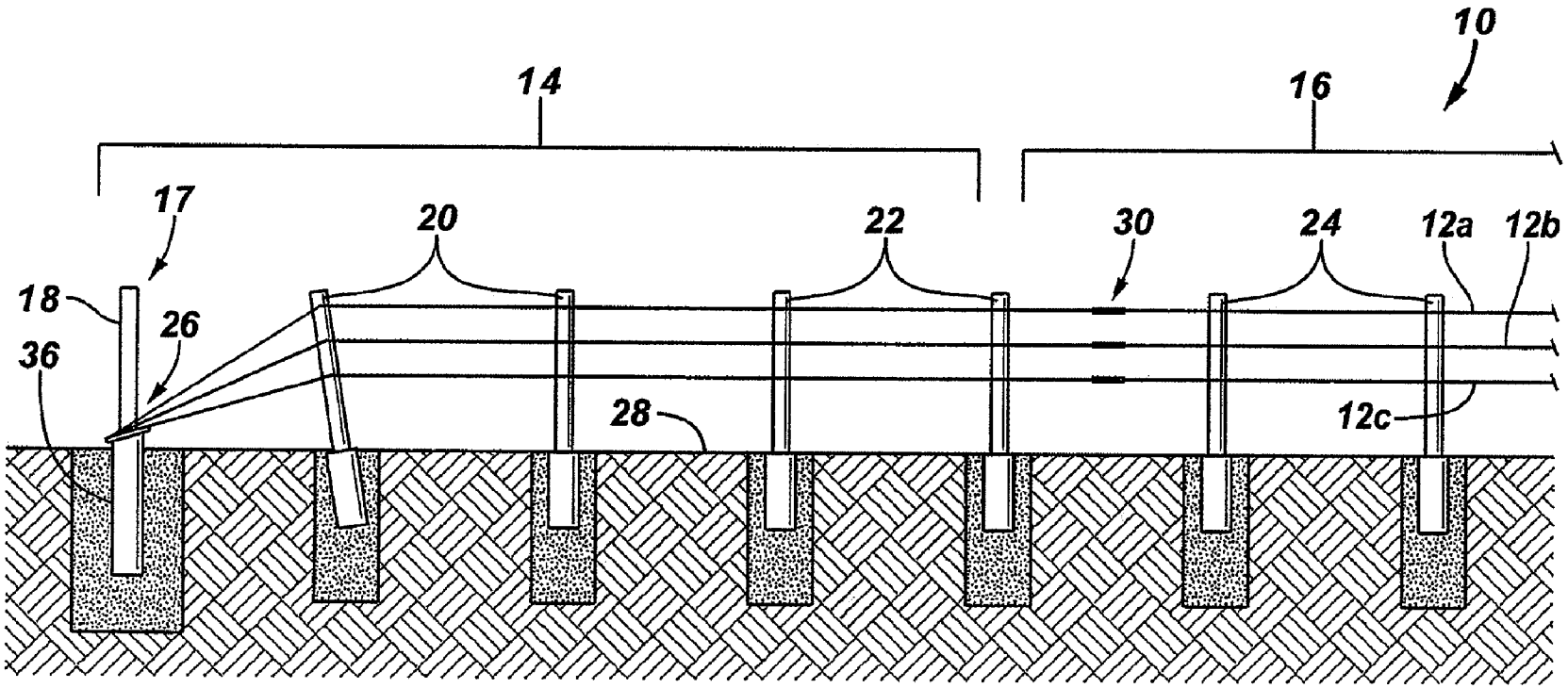
FIG. 1 is a schematic of a section of an embodiment of a cable barrier system of the present invention.

Refer now to the drawings wherein depicted elements are not necessarily shown to scale and wherein like or similar elements are designated by the same reference numeral through the several views.

FIG. 1 is a schematic of a section of an embodiment of a cable barrier system of the present invention, generally identified by the numeral 10. Cable barrier system 10 includes cables 12 held in tension from a terminal end 14 through a length of need 16. Cable barrier system 10 may include additional terminal ends 14 and intermediate terminal ends (not shown). System 10 is illustrated and described herein for exemplary purposes as a three-cable, highway median safety barrier, or cable guardrail. However, it should be realized that the various systems, assemblies, members and concepts described herein may be utilized in various installations and configurations for varying purposes. It should further be understood that various components of the present invention may be utilized with various types and designs of barrier systems including, but not limited to, cable barrier systems, W-beam guardrail systems, crash cushions and attenuators.

Terminal end 14 includes a cable-release anchor assembly 17 having a leveraging member 18, one or more weak terminal posts 20, and one or more standard terminal posts 22. The terminal ends of cables 12 are removably mounted to cable-release anchor assembly 17 substantially at ground level 28 and removably connected to terminal posts 20, 22 and line posts 24 of length of need (LON) section 16. Cables 12 are angled upward relative to ground level 28 through a portion of terminal end section 14 until the desired distance above ground level 26 is obtained. Terminal end 14 is a gated terminal wherein substantially no resistance is provided upon impact by an errant vehicle.

Length of need section 16 includes a plurality of spaced line posts 24. Cables 12 are removably connected to line posts 24 in tension. Length of need 16 may be any desired length. System 10 may include cable splice fittings 30 (FIG. 18) for extending and repairing cables 12. Additionally, cable splice fittings 30 may be utilized to maintain tension in cables 12.

Figure 18:
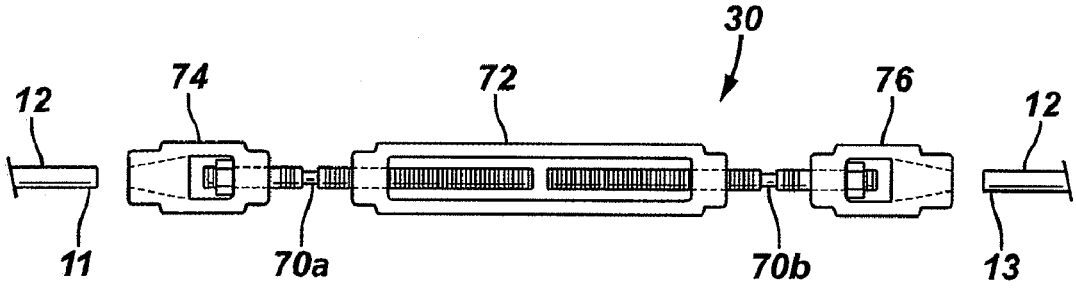
FIG. 18 is a view of a cable splice fitting of the present invention.

Refer now to FIG. 18, wherein an embodiment of a cable splice fitting 30 is shown. Cable splice fitting 30 includes a pair of elongated rods 70*a* and 70*b* connected by a turnbuckle 72. A first connector 74 is connected to elongated rod 70*a* and adapted to connecting to an end 11 of a cable 12. A second connector 76 is connected to elongated rod 70*b* and adapted to connecting to an end 13 of another cable 12. Cable splice fitting 30 facilitates forming and maintaining a spliced, elongated cable 12 in tension.

Referring back to FIG. 1, as is well known in the art, cables 12 are releasably connected to terminal posts 20, 22 and line posts 24 in a manner such that when an individual post fails and is moved toward the ground, cables 12 are released from that post. For example, if a vehicle impacts cable barrier system 10 in length of need section 16 and collapses one post 24 toward the ground, cables 12 are released from that post 24 so that cables 12 remain in contact with the vehicle and do not go under the vehicle. The cables remain supported by the remaining portions of system, urging the vehicle back to its designated and desired path.

Figure 2:
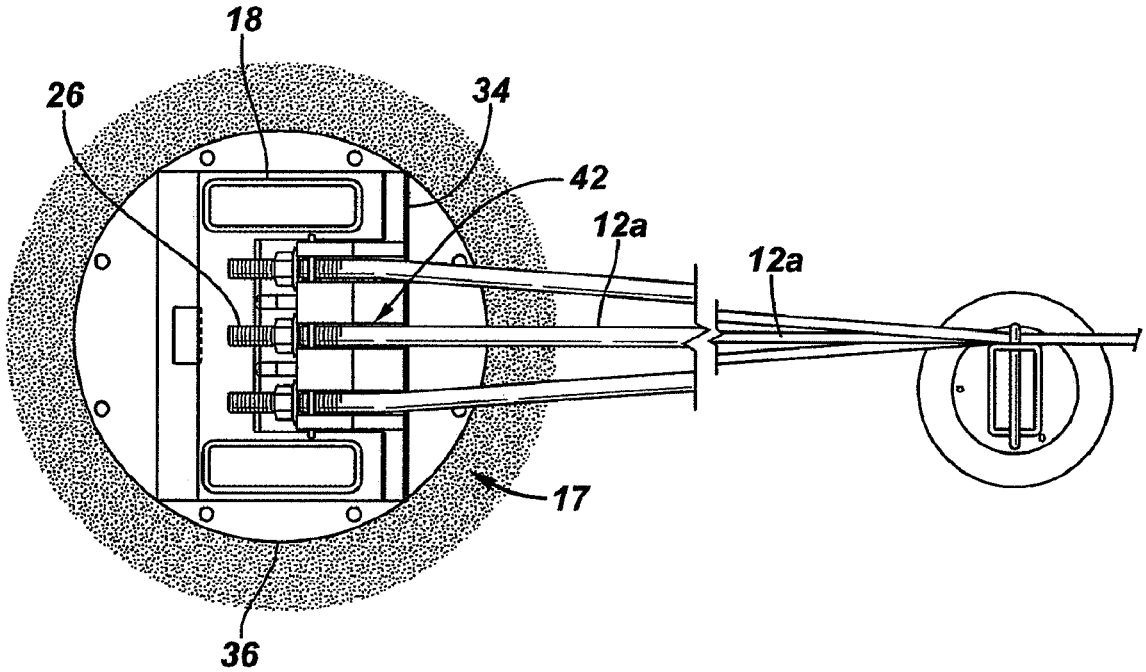
FIG. 2 is a top view of the cable-release anchor assembly and the first terminal post of FIG. 1 in isolation.

FIG. 2 is a top view of cable-release anchor assembly 17 and the first terminal post 20 of terminal end 14, shown in isolation. Terminal ends 26 of cables 12 are removably connected at cable-release anchor assembly 17. As described in further detail below, cable-release assembly 17 may take various designs such that cables 12 are released from tension when cable-release leveraging member 18 is struck by an errant vehicle thereby preventing the vehicle from riding up cables 12. Various embodiments of cable-release anchor assembly 17 include, but are not limited to, an assembly as shown in FIGS. 4 through 9, and/or frangible pins.

As shown in FIG. 2, cables 12 are removably connected to a cable mounting plate 34. Desirably top cable 12*a*, relative to ground level 28, is removably connected in a center position on mounting plate 34. Cable mounting plate 34 is fixedly secured to the pad 36 of cable-release anchor assembly 17. As described further below, pad 36 may take various forms including, but not limited to, being a metal support member. Leveraging member 18 is mounted atop mounting plate 34 with a portion positioned under terminal ends 26 of cables 12. Leveraging member 18 is not secured to mounting plate, as such it is dislodged upon being impacted by a vehicle. In one embodiment of the present invention, when leveraging member post 18 is struck and dislodged, it leverages, or releases, cables 12 from cable-release anchor assembly 17. In the illustrated embodiment, leveraging member 18 is an elongated member such as, but not limited to, a post. Leveraging member 18 is referred to herein broadly, and without limitation, as a post or anchor element, capable of leveraging cable (s) 12 out of connection with anchor plate 34.

Figure 3:
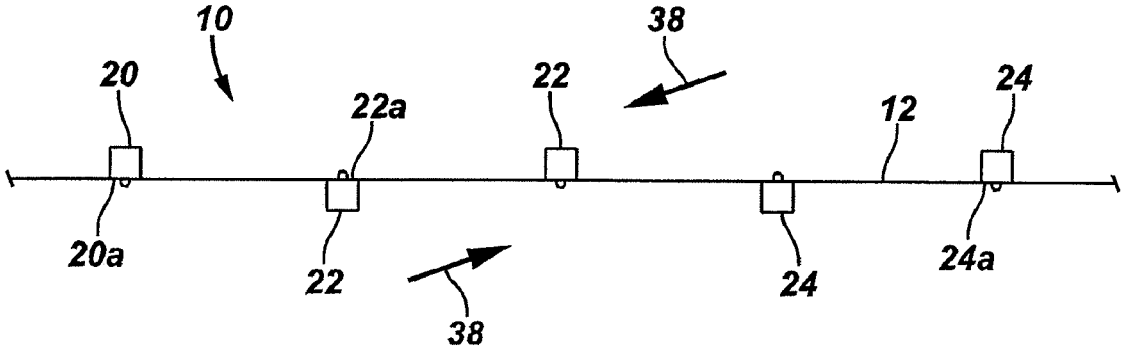
FIG. 3 is a top view of a portion of an embodiment of a cable barrier system of the present invention.

FIG. 3 is a top view of a portion of an embodiment of cable barrier system 10 of the present invention. System 10 illustrates one manner of mounting barrier system 10 for absorbing the impact from errant vehicles and redirecting the errant vehicles from two directions, such as for highway medians. Arrows 38 illustrate the direction of travel of vehicles impacting system 10. Posts 20, 22, and 24 each have a face 20*a*, 22*a*, and 24*a* respectively, adapted for removably mounting cables 12. Post faces 20*a*, 22*a*, and 24*a* are desirably oriented to face oncoming vehicles such that cables 12 are positioned between posts 20, 22, and 24 and the direction of vehicle travel 38. For applications wherein it is probable that vehicles may impact from either direction, posts 20, 22, and 24 may be installed such that at least a portion of post faces 20*a*, 22*a*, and 24*a* are oriented toward oncoming traffic. In the illustrated embodiment, posts 20, 22, and 24 are installed with each post face oriented opposite the orientation of the adjacent post faces.

Figure 4:
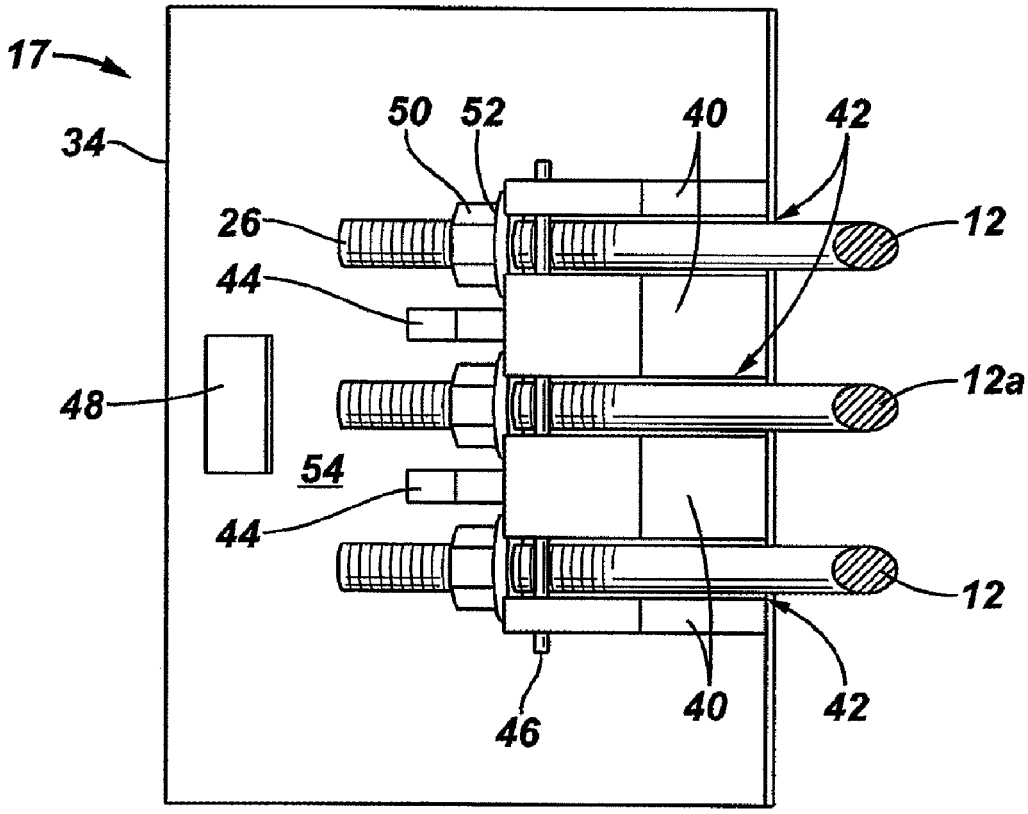
FIG. 4 is a top view of a portion of an embodiment of the cable-release anchor assembly of the present invention.
Figure 5:
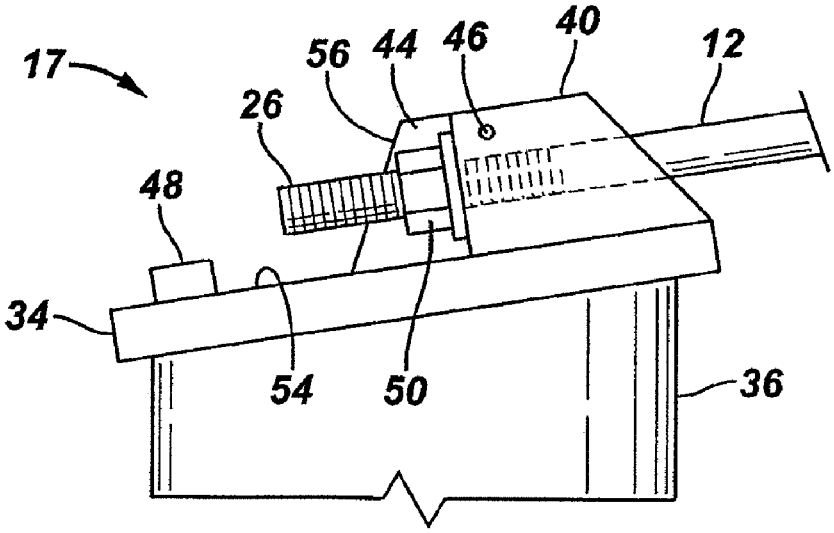
FIG. 5 is a side view of a portion of an embodiment of the cable-release anchor assembly of the present invention.

FIG. 4 is a top view of a portion of an embodiment of cable-release anchor assembly 17 of the present invention. Cable-release assembly 17 is shown in FIGS. 4 and 5 with cable anchor release post 18 (FIGS. 1, and 6 through 9) removed.

Cable-release anchor assembly 17 includes a mounting plate 34. Mounting plate 34 includes a bracket 40 having a plurality of slots 42 each adapted to dispose a cable 12. In the illustrated embodiment slots 42 have an open top. It should be recognized that in other embodiments that the tops of slots 42 may not be open. Cables 12 are mounted in slots 42 with a terminal end fitting 50, illustrated in this embodiment as a nut 52 connected to threaded terminal end 26 of cable 12.

Desirably, a rib 44 is positioned between adjacent slots 42. An optional pin 46 is shown extending through bracket 40. Pin 46 is positioned above cables 12 and substantially perpendicular to the longitudinal axis of cables 12. Pin 46 provides stability: aiding in maintaining cables 12 in slots when tensioning cables 12; maintaining cables 12 in cable-release assembly 17 when cables 12 are impacted further down the length of system 10; maintaining cables 12 in connection with assembly 17 during weather related changes in cables 12; and reducing vibrations in cables 12.

A post stop 48 extends from the same side of mounting plate 34 as bracket 40. Post stop 48 is spaced from bracket 40 to define a leveraging member landing 54 (post landing). Anchor post landing 54 extends under terminal ends 26 of cables 12.

FIG. 5 is a side view of a portion of an embodiment of cable-release anchor assembly 17 of the present invention. Mounting plate 34 is fixedly connected atop pad 36. With reference to FIGS. 1 and 2, pad 36 may be a metal post and connected by welding. Pad 36 may be constructed in various manners as desired and pad 36 and mounting plate 34 connected in a sufficient and appropriate manner. For example, pad 36 may be a concrete pad wherein mounting plate or anchor plate 34 is connected via concrete bolts.

FIG. 5 illustrates rib 44 having a rib face 56 oriented toward post landing 54. Desirably, rib face 56 is non-perpendicular and has an inclined slope away from landing 54. Rib face 56 is sloped to mate with leveraging member 18 as described in relation to FIGS. 6 through 9.

Figure 6:
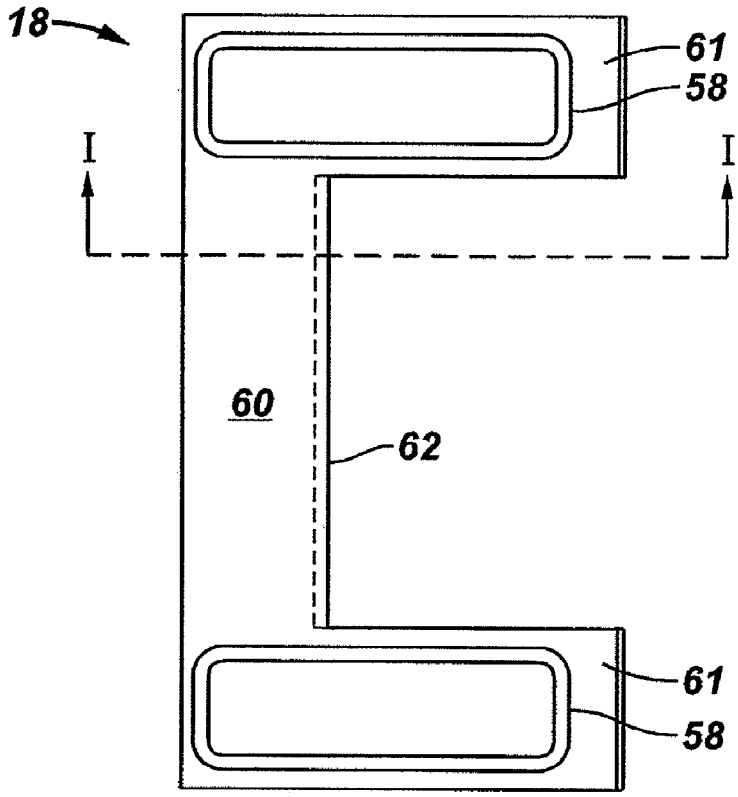
FIG. 6 is a top view of an embodiment of a cable-release anchor leveraging member of the present invention.
Figure 7:
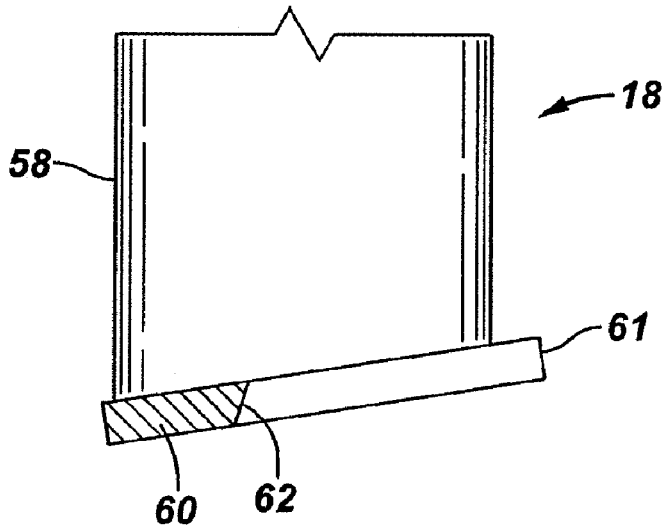
FIG. 7 is a side view of the cable-release anchor leveraging member along section line I-I of FIG. 6.

FIG. 6 is a top view of an embodiment of a cable-release leveraging post 18 of the present invention. Leveraging member 18 of the present embodiment is a high strength steel member having a pair of legs 58 mounted atop feet 61 of a substantially C-shaped base 60. Base 60 includes a toe 62 formed between feet 58. Toe 62 is sloped to correspond with rib face 56 (FIG. 5). FIG. 7 is a side view of cable-release leveraging post 18 along section line I-I of FIG. 6 revealing toe 62.

Figure 8:
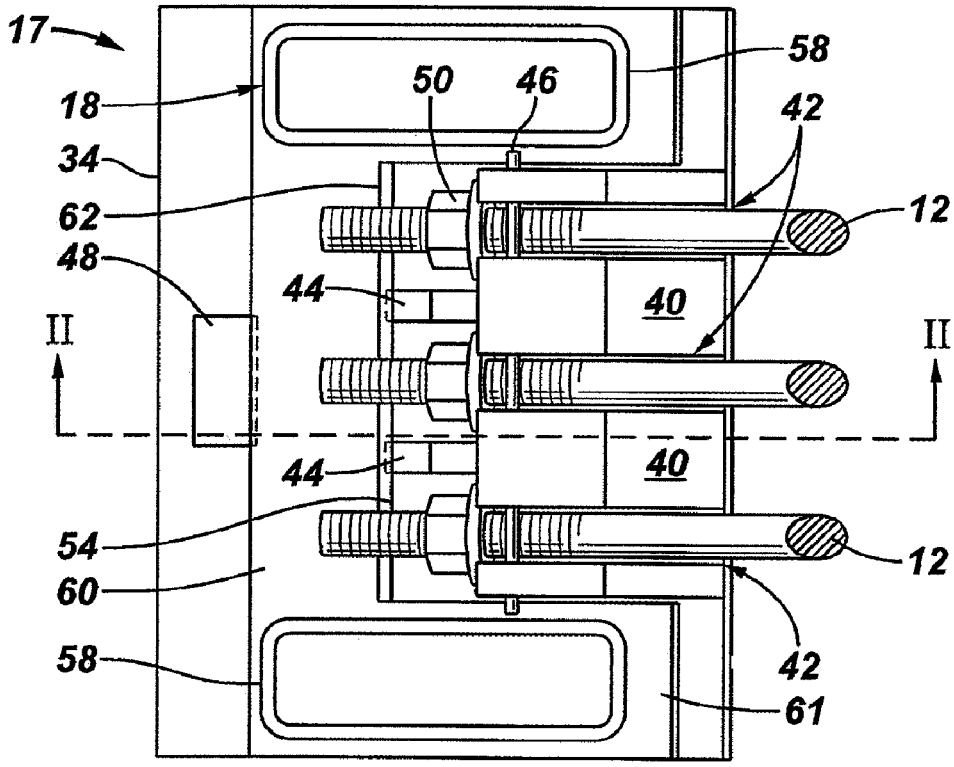
FIG. 8 is a top view of an embodiment of a cable-release anchor assembly of the present invention.

FIG. 8 is a top view of an embodiment of a cable-release anchor assembly 17 of the present invention. Leveraging post 18 is disposed atop mounting plate 34 on post landing 54. Base 60 is disposed between post stop 48 and bracket 40 with feet 61 bracketing cable bracket 40. Cables 12 are disposed in slots 42, and terminal end fitting 50 is operated, tensioning cables 12 against bracket 40.

Figure 9:
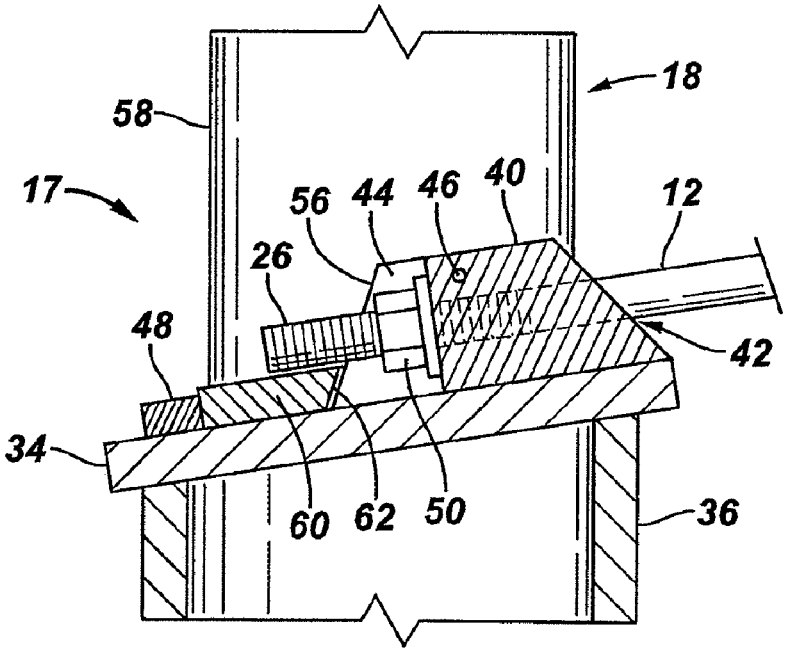
FIG. 9 is a side view of the cable-release anchor assembly along the section line II-II of FIG. 8.

FIG. 9 is a side view of cable-release anchor assembly 17 along the section line II-II of FIG. 8. Base 60 of leveraging post 18 is shown disposed between post stop 48 and bracket 34. Toe 62 is abutting rib face 56. Terminal end 26 of cable 12, or terminal end fitting 50, extends above base 60 of post 18. In operation, when a vehicle impacts post 18, base 60 is dislodged from its position between post stop 48 and bracket 40. As post 18 is dislodged, base 60 leverages cables 12 from slots 42 and bracket 40 thus releasing the tension in cables 12.

Figure 10:
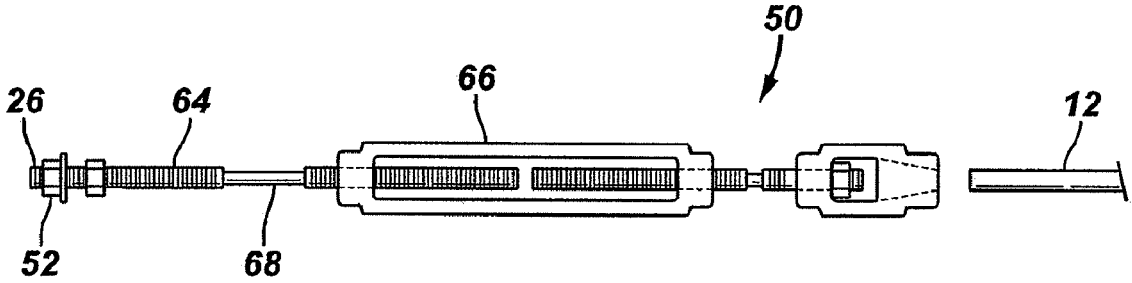
FIG. 10 is an illustration of an embodiment of a terminal end fitting of the present invention.

FIG. 10 is an illustration of an embodiment of a terminal end fitting 50 of the present invention. Terminal end fitting 50 includes an elongated shaft 64 connected to cable 12 via a turnbuckle 66. The end of elongated shaft 64 becoming terminal end 26 of cable 12. Turnbuckle 64 provides a mechanism for tensioning cable 12.

With reference to FIGS. 4 through 10, another embodiment of the present invention is provided. Terminal end 26 of cable 12 includes a reduced diameter, or frangible, portion 68. Slots 42 of bracket 40 are closed across at least a portion of their top (not illustrated). Frangible portion 68 is positioned proximate bracket 40 and slots 42 such that when post 18 leverages terminal ends 26 upward and away from mounting plate 34, frangible portion 68 parts releasing the tension in cables 12.

Figure 11:
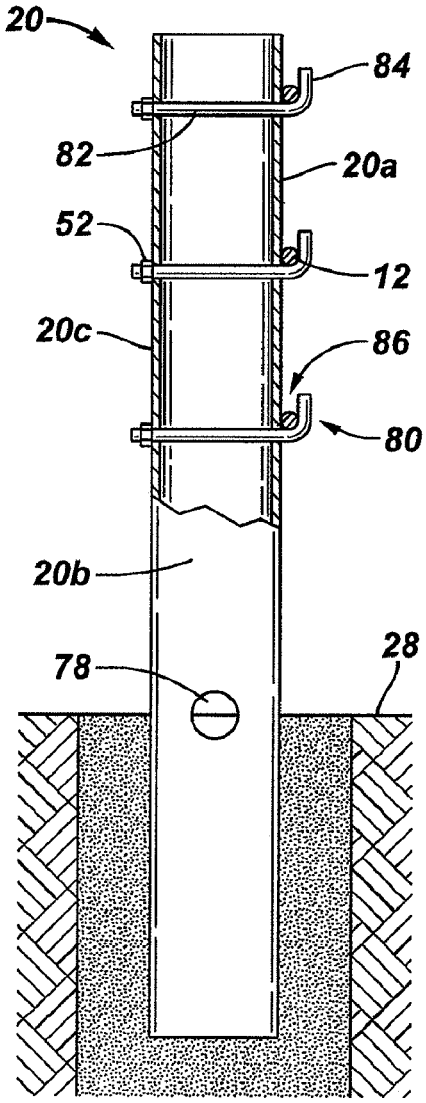
FIG. 11 is a side view of an embodiment of a weak terminal post of the present invention.
Figure 12:
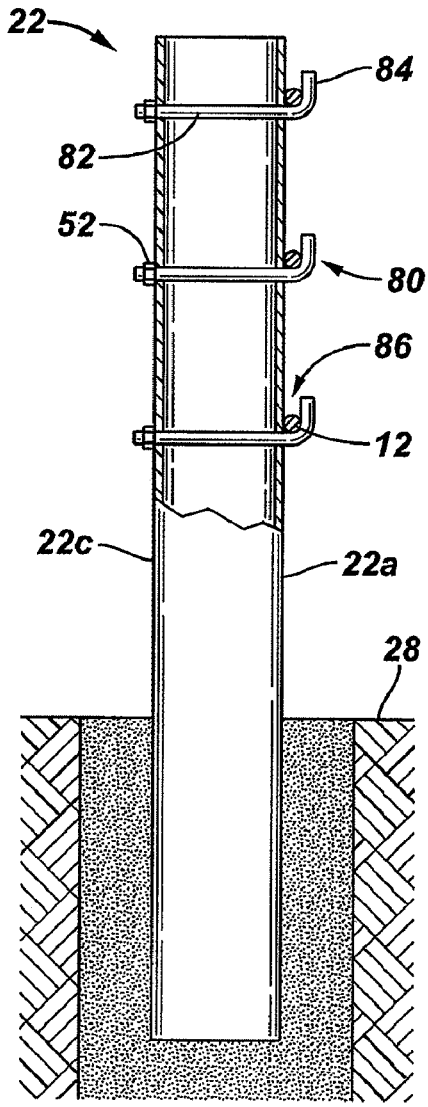
FIG. 12 is a side view of an embodiment of a standard terminal post of the present invention.

FIG. 11 is a side view of an embodiment of a weak terminal post 20 of the present invention. FIG. 12 is a side view of an embodiment of a standard terminal post 22. Posts 20, 22 may be driven in the ground, socketed or supported in any desired manner.

Desirably, weak terminal post 18 includes a hole formed through one or more of its sides proximate ground level 28. FIG. 11 illustrates a hole 78 formed through side 20*b*.

As previously described, cables 12 are removably mounted to terminal posts 20, 22 and line posts 24. In the prior art systems, the cables are often connected to the posts (both terminal and line posts) by hook bolts, of various configurations, that substantially enclose the cable. Desirably, these hook bolts expand when needed to release the cable. However, in practice these hook bolts often fail, compromising the barrier system.

With reference to FIGS. 11 and 12, cables 12 are connected to terminal posts 20, 22 by first cable connectors 80. In an embodiment of the present invention, first cable connectors 80 are "J-bolts" having a substantially elongated longitudinal rod 82 and a riser 84. Riser 84 extends substantially at a right angle to longitudinal rod 82. With reference to FIG. 11, first cable connector cable connector 80 is described for both terminal posts 20 and 22. First cable connector 80 is connected to post 20 such that riser 84 extends outward from a post face 20*a* and vertically relative to ground surface 28 such that a trough 86 is formed for disposing cable 12. Although cables 12 are shown connected to a single side or face of posts 20, 22, and 24 through the various Figures, it should be realized that for each individual post, cables 12 may be mounted on opposing sides of the post.

First cable connector 80 may be connected to post 18 by threading a nut 52 to rod 82 or other suitable means of connection including, but not limited to, welding. A benefit of the present system is that first cable connectors 80 can be connected to post 20 easier and quicker than in the typical prior art systems. A further benefit is that cables 12 may be released from first connectors 80 without deforming the first cable connectors. Thus, one first cable connector does not interfere with the clean release of other post cables as may occur in the prior art systems.

Figure 13:
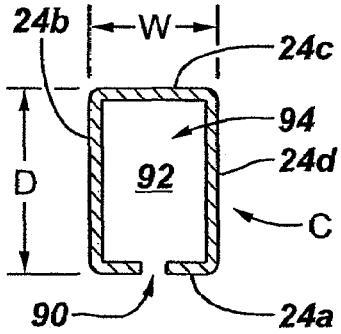
FIG. 13 is a top view of an embodiment of a line post.

With reference to FIG. 13, line post 24 is a C-section post. Post 24 is rectangular, and may be a square, having opposing side walls 24*b* and 24*d* defining the depth D, and a post face wall 24*a* and opposing back wall 24*c* defining the width W of post 24. Post face 24*a* forms a longitudinal slot 90 extending at least a portion of the length of post 24. A cavity 92, having an open top 94, is defined by walls 24*a*, 24*b*, 24*c*, 24*d*. Post 24 of the present invention may take other shapes including circular.

Post 24 is substantially the same strength of typical line posts that do not have a slotted section and are stronger than prior art posts split through opposing side walls. For example, line post 24 is a galvanized steel post having a width W of 2.5 inches, a depth D of 3.75 inches and a 0.5 inch slot. Post 24 weighs 5.4 pounds per foot and has a 75,600 pound bend moment.

Figure 14:
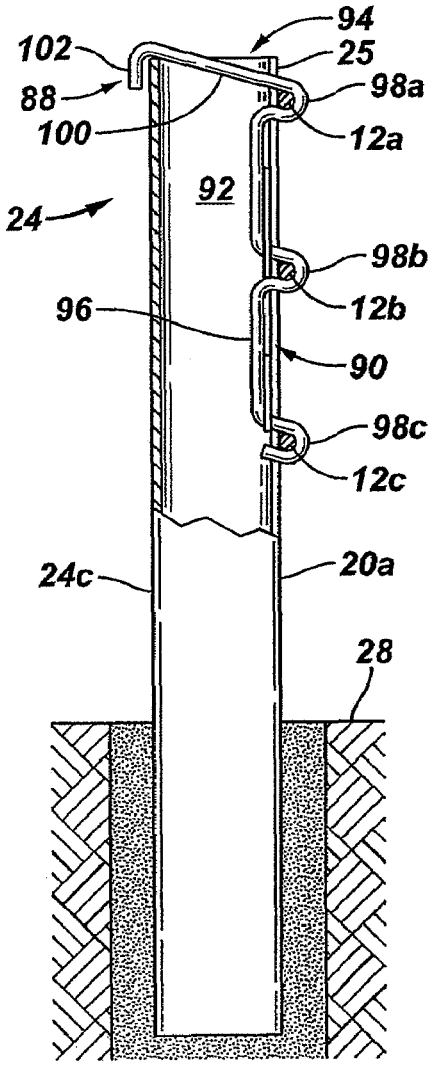
FIG. 14 is a side view of an embodiment of a line post and a hairpin cable connector of the present invention.

FIG. 14 is a side view of an embodiment of a line post 24 and a second or line cable connector 88 of the present invention. Line cable connector 88 is a hairpin shaped connector adapted for removably connecting cables 12 to post 24. Hairpin connector 88 includes an elongated section 96 forming loops 98, each loop adapted to slidingly hold a cable 12. A top section 100 extends at an angle from longitudinal section 96 and terminates with a hooked end 102. Top section 100 is angled such as to depart from parallel with longitudinal section. The angle between top section 100 and longitudinal section 96 is determined by the distance it is desired to position the top cable 12*a* from the top end 25 of post 24 and/or ground level 28. For example, hairpin connector 88 may be formed of a twenty-four inch long round galvanized steel rod. Loops 98*a*, 98*b*, 98*c* are spaced five inches apart. Top loop 98*a* is positioned approximately three inches from top end 25 of post 24.

Hooked end 102 is angled downward from top end 100 toward ground level 28. Hook end 102 may be substantially parallel to longitudinal section 96. Hook end 102 is adapted for mounting on the top end 25 of post 24.

In operation cables 12 may be easily inserted into loops 98 through ports 104. Hairpin connector 88 may then be grasped at top section 100 and removably connected to post 24. Hairpin connector 88 is positioned with longitudinal section 96 disposed within cavity 92 and loops 98 extending through slot 90. Cables 12 are disposed proximate face wall 24*a* exterior of cavity 92. Top section 100 extends through open top 94 and hook end 102 extends over back wall 24*c*. When post 24 is bent toward ground level 28, hairpin connector exits cavity 92 releasing cables 12 from connection with post 24.

Figure 15:
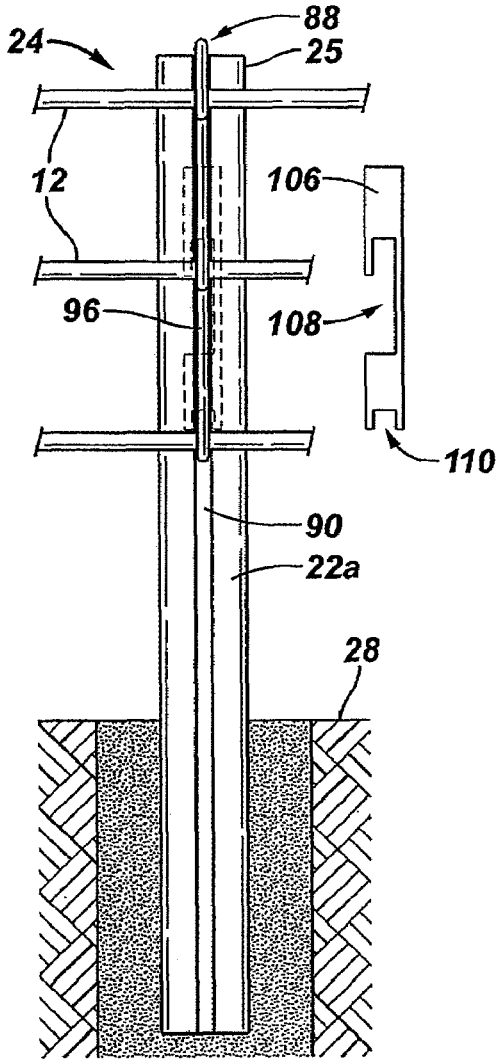
FIG. 15 is a view of an embodiment of a face of the line post to which cables are removably connected illustrating a lock plate.

FIG. 15 is another view of an embodiment of line post 24 of the present invention. Shown adjacent to post 24 is an optional connection lock plate 106. Lock plate 106 is shown in connection with hairpin connector 88 and post 24 by hidden lines in FIGS. 14 and 15. Lock plate 106 is configured to connect with hairpin 88 and be positioned in cavity 92 abutting the interior of face wall 24*a*. Lock plate 106 facilitates the release of one cable 12 at a time from post 24. For example, when post 24 is deformed toward ground level 28 hairpin connector 88 begins to exit cavity 94, top cable 12*a* is released from connection with post 24. If deformation of post 24 ceases, cables 12*b* and 12*c* may remain in connection with post 24 maintaining the integrity of the barrier system. If deformation of post 24 continues, cables 12*b* and 12*c* will be subsequently released.

Lock plate 106 illustrated in FIG. 15 is an embodiment for a three-cable system. Lock plate 106 is a substantially flat member having spaced keyways 108 and 110. First keyway 108 is adapted for disposing the middle loop 98*b* and second keyway 110 is adapted to dispose the bottom loop 98*c*.

Figure 16:
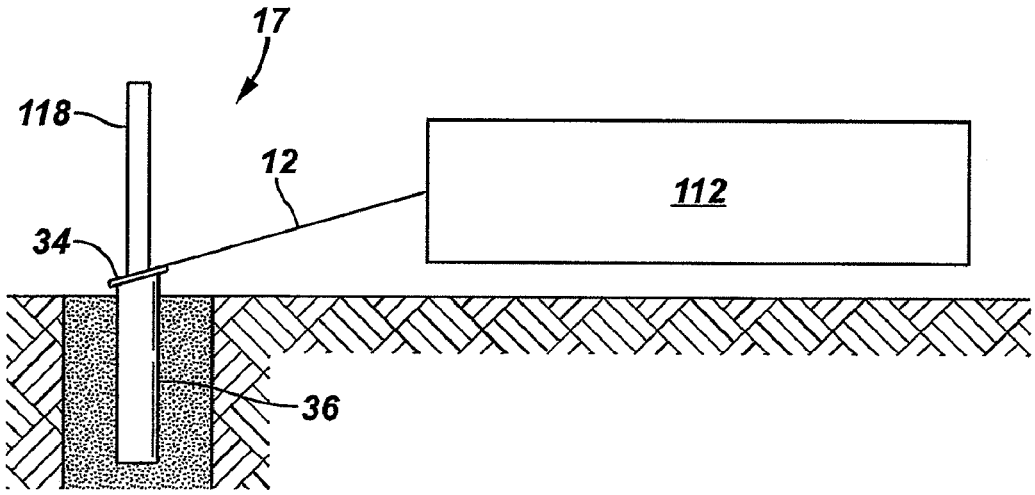
FIG. 16 is a schematic of an embodiment of a cable-release anchor assembly for a barrier system of the present invention.

FIG. 16 is a schematic of an embodiment of a cable-release anchor assembly 17 of the present for a barrier system. Cable-release anchor assembly 17 is illustrated releasably holding a single cable 12 in this embodiment. Barrier system 112 of the present invention may be a cable barrier system such as described with reference to FIGS. 1 and 2. Other examples of barrier system 112 include, but are not limited to, guardrails, guardrail end treatments, and guardrail end terminals.

Figure 17:
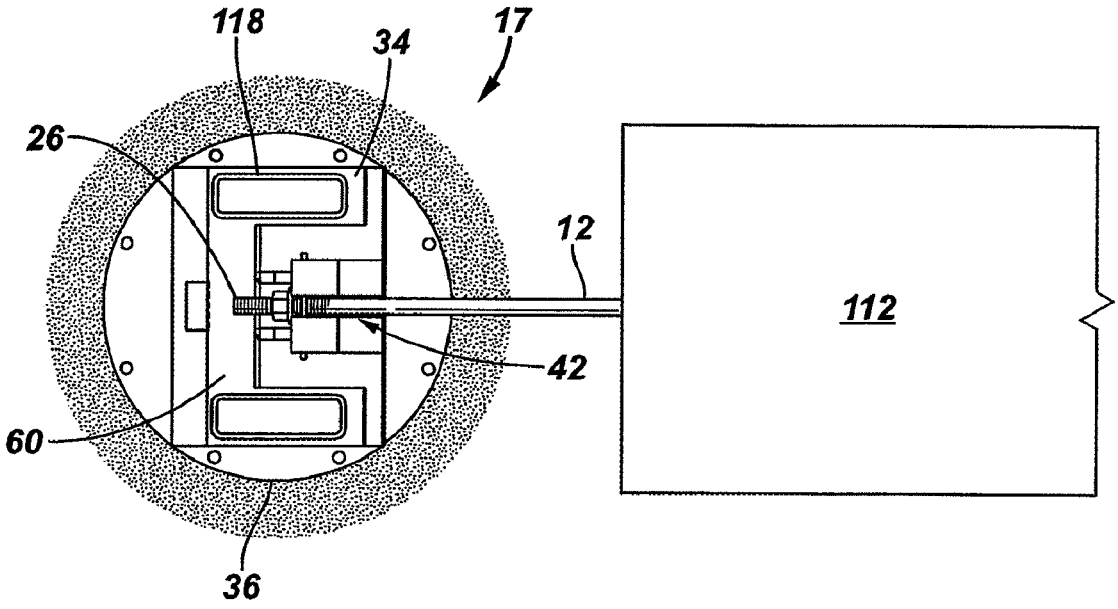
FIG. 17 is a top view of the cable-release anchor assembly of FIG. 16.

FIG. 17 is a top view of cable-release anchor assembly 17 of FIG. 16. The figure illustrates a single cable 12 releasably connected to cable mounting plate 34. With reference to FIGS. 16 and 17, post 18 of FIGS. 1 and 2 has been replaced by a post element 118. Post member 118 is defined broadly as a member for releasing cable 12 from anchor plate 34. Post member 118 may include, but is not limited to, elongated post members and terminal heads. As illustrated post member 118 has a base member positioned below terminal end 26 of cable 12 in a manner to leverage cable 12 from anchor plate 34 when impacted.

From the foregoing detailed description of specific embodiments of the invention, it should be apparent that safety systems and assemblies that are novel have been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A cable-release anchor assembly for a barrier system, the assembly comprising:

a cable mounting plate having a bracket adapted for removably connecting a cable proximate its terminal end, the cable connectable to a barrier system;

the bracket having a sloped leveraging face;

a stop extending from the cable mounting plate spaced from the bracket to define a landing area;

a leveraging member having a base, the base disposed on the landing area below the terminal end of the cable in a manner such that it is not secured to the cable mounting plate;

the base having a toe sloped to correspond and abut the sloped leveraging face; and a leg extending from the base above the terminal end of the cable:

wherein when the leveraging member is impacted by a sufficient force by a vehicle the base leverages the cable from connection with the cable mounting plate.

2. The assembly of claim 1, wherein the barrier system is a W-beam guardrail system.

3. The assembly of claim 1, wherein the barrier system is a cable barrier system.

4. The assembly of claim 1, wherein the barrier system is an energy-absorption system.

* * * * *